United States Patent [19]

Beilfuss, Sr.

[11] Patent Number: 5,000,455

[45] Date of Patent: Mar. 19, 1991

[54] SAND AND WATER WEDGE FOR GOLF

[76] Inventor: Freeman C. Beilfuss, Sr., 120 Northbrook SE., Grand Rapids, Mich. 49508

[21] Appl. No.: 566,680

[22] Filed: Aug. 13, 1990

[51] Int. Cl.[5] ..... A63B 53/04

[52] U.S. Cl. ..... 273/175; 273/167 E

[58] Field of Search ..... 273/167 E, 167 J, 175, 273/169, 170, 171, 172, 167 A, 167 F

[56] References Cited

U.S. PATENT DOCUMENTS

| | | | |
|---|---|---|---|
| 780,776 | 1/1905 | Brown | 273/175 |
| 1,089,881 | 3/1914 | Taylor | 273/175 |
| 1,414,124 | 4/1922 | Griffin | 273/175 |
| 3,719,359 | 3/1973 | Evans | 273/167 J |
| 4,809,982 | 3/1989 | Kobayashi | 273/167 E |
| 4,869,508 | 9/1989 | Miller | 273/175 |

*Primary Examiner*—George J. Marlo
*Attorney, Agent, or Firm*—Price, Heneveld, Cooper, DeWitt & Litton

[57] ABSTRACT

A sand wedge is provided with an improved club head which is designed to substantially cut through sand or water thus minimizing drag and allowing a golfer to strike a golf ball with less interference from the sand or water. The club head has a perimeter support wall and a plurality of vertically spaced fins connected to and extending between the upper and lower elongated sides of the support wall. The support wall has a generally thin looping profile with the interior side surfaces of the perimeter support wall being generally aligned with a golfer's swing. The fins are vertically spaced within the perimeter support wall and define openings at least three times the width of the fins, thus allowing sand or water to pass substantially freely through the club head. The perimeter support walls are similar in thickness to the fins, both being designed with draft angles as required for manufacture. The club head also has a hosel portion having a thinly profiled streamlined cross-section and a sharpened leading front edge.

9 Claims, 1 Drawing Sheet

SAND AND WATER WEDGE FOR GOLF

BACKGROUND OF THE INVENTION

The present invention relates° to golf clubs, and particularly to a wedge for use in sand, water or similar hazards which may exist on a golf course.

Conventional sand wedges in affect require a golfer to blast the golf ball out of a sand trap or out of water. This not only is difficult but, particularly for less skilled golfers, can be frustrating. Wedges have been suggested which allow for some relief from the dragging effect of sand and water such as U.S. Pat. No. 4,869,508. However, a significant problem of dragging remains, and the golfer is still required to effectively 'blast' the ball out of the hazard particularly where the golf ball is buried a distance into the sand or is in a substantial amount of water. Not only is a significant amount of energy required to be directed toward moving sand or water mass, but particularly with water, the debris flies in all directions. Further, control of the golf shot is immensely reduced since many golfers are unsure as to how hard to swing.

SUMMARY OF THE INVENTION

The present invention is embodied in an improved golf club for use in sand and water hazards which allows the club head to substantially cut or slice through sand and water hazards with minimal drag. The golf club has an elongated handle connected to one end of an ovally shaped club head, the club head having an inclined front face for striking a golf ball. The improvement resides primarily in the club head which has a substantially open and inclined ovally shaped front face with multiple enlarged openings The club head include a perimeter support wall and a plurality of vertically spaced fins connected to and extending between the upper and lower elongated sides of the perimeter wall. The vertically spaced fins are spaced within the perimeter support wall to define openings therebetween at least three times the width of the fins. The perimeter support wall has a generally thin looping profile with the width of the leading surfaces of the lower elongated sides thereof approximating the width of the fins.

These and other features, objects, and advantages of the present invention will become apparent upon reading the following description thereof, together with reference to the accompanying drawings in which:

DETAILED DESCRIPTION OF PREFERRED EMBODIMENTS

Figure 1:
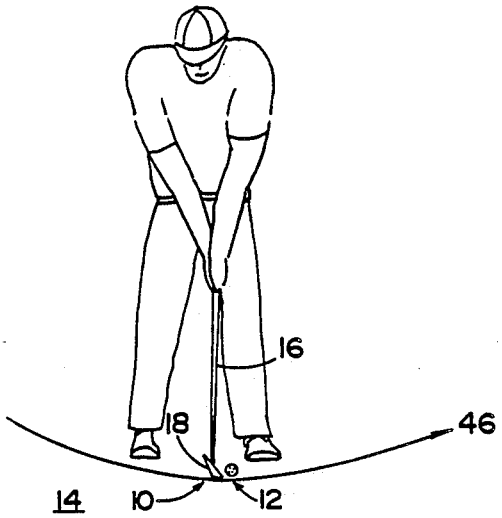
FIG. 1 is an elevated side view of a golf club embodying the present invention in use.
Figure 2:
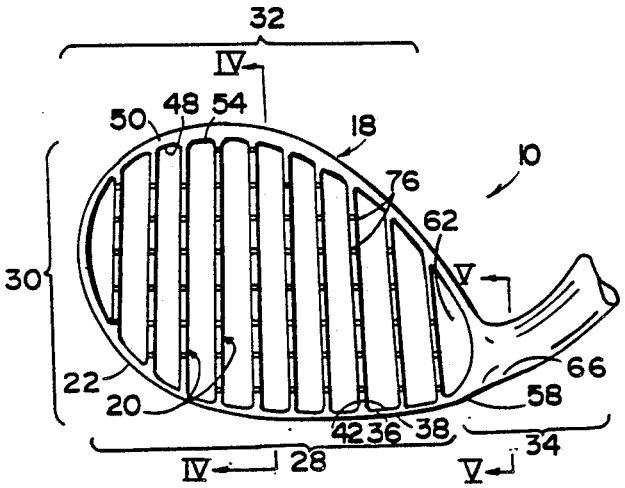
FIG. 2 is a partial front view showing golf club a embodying the present invention.

Referring initially to FIG. 1 and 2, the present invention is shown embodied in a golf club wedge 10 which can be used to pitch a golf ball 12 from hazards 14 such as sand, water, and the like. Wedge 10 includes a handle 16 and head 18, head 18 including multiple vertical and parallel fins 20 arranged within a thinly profiled perimeter support wall 22 and between inclined club front face 24 and club back face 26. Fins 20 and perimeter support wall 22 are arranged in substantial alignment with a golfer's swing and create a highly open club face 24. This allows wedge 10 to substantially slice through sand and water to strike golf ball 12. Areas on wedge head 18 having somewhat thicker profiles are given a sharp front edge and an inclined streamlined cross-section to further reduce resistance as head 18 slices through sand 14.

Figure 3:
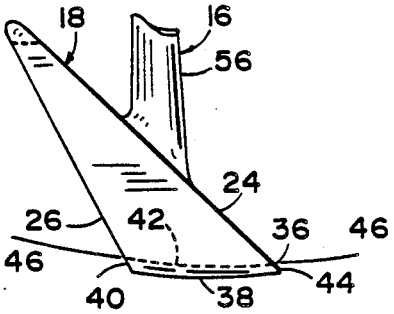
FIG. 3 is a partial side view of the embodiment shown in FIG. 2.
Figure 4:
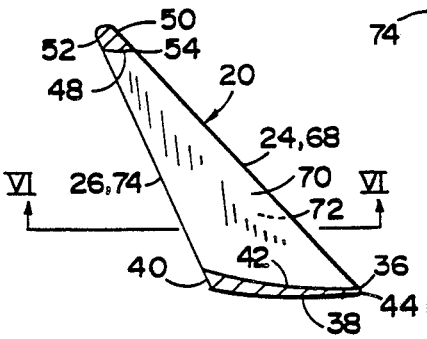
FIG. 4 is a cross-sectional view taken thru lines IV—IV in FIG. 2.

Perimeter support wall 22 of head 18 will now be described as shown in FIG. 2–4. Perimeter support wall 22 extends around the outer edge of head 18 in a loop shaped or oval fashion, support wall 22 being divided into a lower elongated side portion 28, outward end portion 30, upper elongated side portion 32, and hosel portion 34. Lower portion 28 is a substantially flat web with a front thickness in the order of 1/32" and is defined by a front surface 36, bottom surface 38, rear surface 40 and top surface 42. Front surface 36 lies generally horizontally and in the plane of front face 24. Front surface 36 joins with bottom surface 38 to form a knife-like leading front edge 44. Leading edge 44 is the first part of club head 18 to contact sand 14 and is suitably shaped as described to slice into sand 14 with minimal resistance. Bottom surface 38 and top surface 42 extend rearwardly from front surface 36 in an arcuate fashion which substantially approximates the arc of a golfer's swing 46. Surfaces 38 and 42 are varied as required during manufacture to facilitate the manufacture of club head 18 as such as by giving surfaces 38 and 42 draft angles. Surfaces 38 and 42 extend rearwardly a distance sufficient to form a non-deformable and rigid support wall or web, and are then connected by rear surface 40. Rear surface 40 lies generally horizontally and in the plane of club back face 26.

Outward end portion 30 extends arcuately upwardly from the outer end of lower portion 28 in a looping fashion, end portion 30 also being a web shaped member having an elongated cross-section similar to lower portion 28. However, the cross-sectional length of side portion 30 gradually decreases as side portion 30 extends upwardly due to the difference in pitch of front face 24 over back face 26.

Upper elongated side portion 32 extends from end portion 30 in a looping fashion back toward the base of handle 16. Upper portion 32 has a triangularly shaped cross-section defined by a lower surface 48, front surface 50, and back surface 52. Upper portion 32 is designed with a foreshortened horizontal depth in order to allow sand 14 to release quickly from the back side of club 18. As a result, the vertical profile of upper portion 32 is necessarily increased in order to give upper portion 32 proper strength and stiffness. However, it has been found that by aligning lower surface 48 with the arc of a golfer's swing 46 and by giving the cross-section a knife-like front edge 54, the drag from sand 14 is still acceptably minimized even with a vertical thickness profile of up to ⅛" or more.

Figure 5:
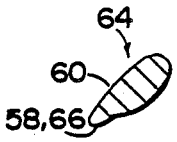
FIG. 5 is a cross-sectional view taken thru lines V—V in FIG. 2.

Hosel portion is a "Y" shaped structure which joins upper portion 32 and lower portion 28 thus completing perimeter support wall 22 into a complete ring. Hosel portion 34 also provides a means 56 to attach club head 18 to handle 14, means 56 extending upwardly and sidewardly at a strategic obtuse angle to connect to club handle 16. Hosel portion 34 is a solid mass sufficient to transmit forces as needed to carry club head through sand 14 and into golf ball 12 Hosel portion has an aerodynamically designed leading edge 58 to minimize sand drag which corresponds to and is an extension of leading edge 44 of lower elongated side portion 32. Hosel portion 34 has an inclined front surface 60 which acts to direct sand upwardly and over the tip of hosel portion 34. Further, an enlarged opening 62 is located near the base of hosel portion 34 and assists in drawing away sand 14. Where drag cannot be avoided such as where the hosel mass extends upwardly toward handle 16, drag is minimized by a sleek oblong cross-sectional profile 64 with a narrowed leading tip 66 a shown in FIG. 5.

Figure 6:
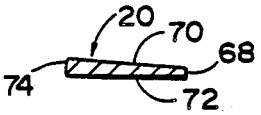
FIG. 6 is a partial cross-section taken thru lines VI—VI in FIG. 4.

Fins 20 will now be described as shown in FIG. 2, 4, and 6. Fins 20 are generally thin triangular shapes, approximately eight to ten or more in number, and extend from club front face 24 to club back face 26 and from lower elongated side portion 28 to upper elongated side portion 32. Fins 20 run parallel to each other and have a substantially vertical profile as club 10 sets immediately prior to ball impact. Fins 20 have a front edge 68 of approximately 1/32" thickness which lies on and substantially forms club face 24. The distance between fins 20 is generally a ratio of gap to fin thickness of at least 3 to 1. This minimizes drag. Fins are generally defined by front edge 68, sides 70 and 72, and rear surface 74. As best shown in FIG. 4, Fins 20 have a front surface 68 and side surfaces 70 and 72 which are generally flat, but with side surfaces 70 and 72 being drafted as required to facilitate manufacture (FIG. 6). Fins 20 are radiused slightly as fins 20 join to lower portion 28 and upper portion 32 to allow for manufacture an also to prevent sticking of sand which would increase drag. Grooves 76 are located on club face 24 on fins 20 per United States Golf Association (USGA) regulations, said regulations substantially allowing a maximum groove depth of 0.20" (0.5mm), maximum groove width of 0.35" (0.9mm) and a maximum groove density of three times groove width but not less than 0.075" (1.9mm) per groove. Grooves 76 extend perpendicularly to fins 20 horizontally on club front face 24.

Operation

Having thus described the apparatus, the operation of this invention should become evident. Briefly, a golfer selects wedge 10 when his golf ball 12 has landed in the hazard such as a sand trap. Wedge 10 is particularly useful where ball 12 is somewhat submerged into the hazard such that a "normal" golf shot is not possible. The golfer aligns himself such that the swing of wedge 10 will form an arc 46 which will cut through sand 12 and into ball 12. As the golfer swings, wedge 10 first touches sand 14 at leading edge 44 along lower portion 28. As wedge 10 further proceeds toward ball 12, the thinly profiled club front face 24 enters sand 14 with minimal disruption. Particles of sand 14 that are disturbed begin to slip upwardly over lower elongated side portion 28 and between fins 20. Sand 12 also is funneled thru enlarged opening 62 and upwardly and rearwardly on front hosel surface 60. As wedge head 18 continues into sand 14 and strikes ball 12, the golfer is able to continue his swing and bring ball 12 thru interfering sand 14 and out of the hazard area with substantially a full and controlled golf swing due to the minimal drag. Fins 20 are strategically spaced closely enough to allow a good degree of control over direction of the golf ball as it leaves the club face 24, but spaced apart enough to minimize sand drag. In testing, the inventor notes that ball 12 does not ricochet sideways or tend to be cut to the degree that might initially be expected. At the same time, drag due to sand interference is greatly reduced and the effects of blasted sand on the ball are greatly reduced such that the ultimate shot is made with much greater accuracy in distance and direction. The grooves 76 and fins 20 allow for increased gripping of ball 12 and still greater ball control.

For extremely difficult shots such as balls 12 which are located deeply within sand 12 or water, upper portion 32 and hosel portion 34 are provided with knife-like front edges, 54, 58, 66, and inclined surfaces 50 and 60 which maximize aerodynamics and minimize the club front profile such that increasing depths may be reached with minimum effort and with maximum results.

It should be evident from the above description that I have provided a wedge for use in golf which can be used to pitch golf balls from various hazards such as sand, water, and the like. This is made possible by the unique construction of the wedge head which allows the club to slice through sand and hazards as herein described.

Having described our invention, it should be understood that although a preferred embodiment has been disclosed herein, other modifications and embodiments can be utilized without departing from spirit of this invention. Therefore, this invention should not be limited to only the embodiment illustrated, which has been described as an example only.

The embodiments of the invention in which an exclusive property or privilege is claimed are defined as follows.

1. An improvement in a golf club for use in sand and water hazards found on golf courses, said golf club having an elongated handle connected to one end of an ovally shaped club head, said club head having an inclined front face for striking a golf ball, said improvement being a club head designed to substantially cut through said hazards with minimal drag, said improvement comprising:

said club head having a substantially open and inclined ovally shaped front face with multiple enlarged openings for permitting said club head to cut through said hazards;

said club head including a perimeter support wall and a plurality of vertically spaced fins connected to and extending between the upper and lower elongated sides of said perimeter support wall of said club head;

said vertically spaced fins being spaced within said perimeter support wall to define openings therebetween, at least three times the width of said fins; and said perimeter support wall having a generally thin looping profile with the width of the leading surface of said lower elongated side thereof approximating the width of said fins.

2. The apparatus as defined by claim 1 wherein said perimeter support wall has interior surfaces generally aligned with a golfer's swing.

3. The apparatus as defined by claim 1 wherein said fins have a front profile width of about 1/32".

4. The apparatus as defined by claim 1 wherein said fins are 8 to 10 in number.

5. The apparatus as defined by claim 1 wherein said fins and said perimeter support wall have a draft angle sufficient to facilitate manufacture.

6. The apparatus as defined by claim 1 wherein said perimeter support wall has a elongated lower portion extending from front to back; and said lower portion has a streamlined profile including an inclined front surface having a knife-like front edge and generally horizontal upper and lower surfaces that are generally aligned with the arc of a golfer's swing.

7. The apparatus as defined by claim 1 wherein an enlarged opening is positioned adjacent said hosel portion to assist in funneling sand away from said hosel portion as said club head traverses through said hazard.

8. The apparatus as defined by claim 1 wherein said perimeter support wall has an outward end; and said outward end has a width approximating the width of said fins.

9. The apparatus as defined by claim 1 wherein said hosel portion has an inclined front surface and thinly profiled cross-section with a sharpened leading front edge to reduce drag from hazards.

* * * * *